US010848890B2

(12) United States Patent
Chung et al.

(10) Patent No.: US 10,848,890 B2
(45) Date of Patent: Nov. 24, 2020

(54) BINAURAL AUDIO SIGNAL PROCESSING METHOD AND APPARATUS FOR DETERMINING RENDERING METHOD ACCORDING TO POSITION OF LISTENER AND OBJECT

(71) Applicant: GAUDI AUDIO LAB, INC., Seoul (KR)

(72) Inventors: Hyunjoo Chung, Seoul (KR); Hyunoh Oh, Seongnam-si (KR); Sangbae Chon, Seoul (KR)

(73) Assignee: GAUDI AUDIO LAB, INC., Seoul (KR)

( * ) Notice: Subject to any disclaimer, the term of this patent is extended or adjusted under 35 U.S.C. 154(b) by 26 days.

(21) Appl. No.: 16/240,781

(22) Filed: Jan. 6, 2019

(65) Prior Publication Data

US 2019/0215632 A1 Jul. 11, 2019

(30) Foreign Application Priority Data

Jan. 5, 2018 (KR) ..... 10-2018-0001819

(51) Int. Cl.
*H04S 7/00* (2006.01)
*H04R 5/04* (2006.01)
*H04S 1/00* (2006.01)

(52) U.S. Cl.
CPC ..... *H04S 7/30* (2013.01); *H04R 5/04* (2013.01); *H04S 1/007* (2013.01); *H04S 2400/01* (2013.01); *H04S 2400/11* (2013.01); *H04S 2420/01* (2013.01); *H04S 2420/11* (2013.01)

(58) Field of Classification Search
CPC ..... H04S 1/005; H04S 1/007; H04S 7/30; H04S 7/302; H04S 7/303; H04S 7/304; H04S 2400/01; H04S 2400/11; H04S 2420/01; H04S 2420/11; H04R 5/04; H04R 5/033
USPC ..... 381/1, 17–23, 309, 310, 26
See application file for complete search history.

(56) References Cited

U.S. PATENT DOCUMENTS

| | | | | |
|---|---|---|---|---|
| 5,404,406 | A * | 4/1995 | Fuchigami | H04S 1/002 381/17 |
| 9,088,858 | B2 * | 7/2015 | Kraemer | H04S 7/30 |
| 9,197,979 | B2 * | 11/2015 | Lemieux | H04S 3/002 |
| 9,848,275 | B2 * | 12/2017 | Lee | H04S 7/303 |
| 10,165,381 | B2 * | 12/2018 | Baek | H04S 7/304 |
| 10,271,157 | B2 * | 4/2019 | Jeon | H04S 3/008 |
| 2013/0101122 | A1 * | 4/2013 | Yoo | G10L 19/008 381/17 |
| 2014/0133682 | A1 * | 5/2014 | Chabanne | H04R 5/02 381/300 |
| 2016/0066118 | A1 * | 3/2016 | Oh | G10L 19/008 381/303 |

(Continued)

*Primary Examiner* — Xu Mei
(74) *Attorney, Agent, or Firm* — Park, Kim & Suh, LLC

(57) ABSTRACT

Disclosed is an audio signal processing device for processing an audio signal. The audio signal processing device includes a processor. The processor obtains an input audio signal including an object audio signal, selects at least one of a plurality of rendering methods based on an azimuth of a sound object with respect to a listener, corresponding to the object audio signal in a virtual space simulated by an output audio signal, renders the object audio signal using a selected rendering method, and outputs the output audio signal including the rendered object audio signal.

18 Claims, 8 Drawing Sheets

(56) References Cited

U.S. PATENT DOCUMENTS

| | | | | |
|---|---|---|---|---|
| 2016/0080886 | A1* | 3/2016 | De Bruijn | H04S 7/308<br>381/17 |
| 2017/0251323 | A1* | 8/2017 | Jo | H04S 5/00 |
| 2018/0091919 | A1* | 3/2018 | Chon | H04S 3/008 |
| 2018/0276476 | A1* | 9/2018 | Eronen | G06T 19/006 |

* cited by examiner

BINAURAL AUDIO SIGNAL PROCESSING METHOD AND APPARATUS FOR DETERMINING RENDERING METHOD ACCORDING TO POSITION OF LISTENER AND OBJECT

CROSS-REFERENCE TO RELATED APPLICATION

This application claims priority to Korean Patent Application No. 10-2018-0001819 filed on Jan. 5, 2018 and all the benefits accruing therefrom under 35 U.S.C. § 119, the contents of which are incorporated by reference in their entirety.

BACKGROUND

The present invention relates to an audio signal processing method and device. More specifically, the present invention relates to a binaural audio signal processing method and device.

3D audio commonly refers to a series of signal processing, transmission, encoding, and playback techniques for providing a sound which gives a sense of presence in a three-dimensional space by providing an additional axis corresponding to a height direction to a sound scene on a horizontal plane (2D) provided by conventional surround audio. In particular, to provide 3D audio, a rendering technique for forming a sound image at a virtual position where a loudspeaker does not exist even if a larger number of loudspeakers or a smaller number of loudspeakers than that for a conventional technique are used may be needed.

3D audio is expected to become an audio solution to an ultra high definition TV (UHDTV), and is expected to be applied to various fields of theater sound, personal 3D TV, tablet, wireless communication terminal, and cloud game in addition to sound in a vehicle evolving into a high-quality infotainment space.

Meanwhile, a sound source provided to the 3D audio may include a channel-based signal and an object-based signal. Furthermore, the sound source may be a mixture type of the channel-based signal and the object-based signal, and, through this configuration, a new type of content experience may be provided to a user.

Binaural rendering is performed to model such a 3D audio into signals to be delivered to both ears of a human being. A user may experience a sense of three-dimensionality from a binaural-rendered 2-channel audio output signal through a headphone, an earphone, or the like. A specific principle of the binaural rendering is described as follows. A human being listens to a sound through two ears, and recognizes the location and the direction of a sound source from the sound. Therefore, if a 3D audio can be modeled into audio signals to be delivered to two ears of a human being, the three-dimensionality of the 3D audio can be reproduced through a 2-channel audio output without a large number of loudspeakers.

SUMMARY

The present disclosure provides an audio signal processing method and device for processing an audio signal.

The present disclosure also provides an audio signal processing method and device for processing a binaural audio signal.

The present disclosure also provides an audio signal processing method and device for determining a rendering method according to the positions of a listener and a sound source.

In accordance with an exemplary embodiment of the present invention, an audio signal processing device for rendering audio signals includes: a processor configured to obtain an input audio signal including an object audio signal, select at least one of a plurality of rendering methods based on an azimuth of a sound object with respect to a listener, corresponding to the object audio signal in a virtual space simulated by an output audio signal, render the object audio signal using a selected rendering method, and output the output audio signal including the rendered object audio signal.

The plurality of rendering methods may include a first rendering method and a second rendering method.

The processor may render the object audio signal using the first rendering method when the azimuth of the sound object with respect to the listener is within a first predetermined azimuth range, and render the object audio signal using the second rendering method when the azimuth of the sound object with respect to the listener is within a second predetermined azimuth range. Here, a difference between an azimuth corresponding to the first predetermined azimuth range and an azimuth in a front head direction of the listener may be smaller than a difference between an azimuth corresponding to the second predetermined azimuth range and the azimuth in the front head direction of the listener.

The first rendering method may require a higher calculation complexity compared to the second rendering method.

The first rendering method may be a head-related impulse response (HRIR)-based rendering method, and the second rendering method may be a panning-based rendering method.

The processor may model a plurality of sound objects into one sound object based on a distance between the sound objects to perform rendering according to the second rendering method.

The first rendering method may cause less distortion in timbre compared to the second rendering method.

The first rendering method may be a panning-based rendering method, and the second rendering method may be a HRIR-based rendering method.

The processor may render the object audio signal using the first rendering method and the second rendering method when the azimuth of the sound object with respect to the listener is within a third predetermined azimuth range, and may generate the output audio signal by mixing an object audio signal rendered using the first rendering method and an object audio signal rendered using the second rendering method. A difference between an azimuth corresponding to the first predetermined azimuth range and the azimuth in the front head direction of the listener may be smaller than a difference between an azimuth corresponding to the third predetermined azimuth range and the azimuth in the front head direction of the listener. Here, the difference between the azimuth corresponding to the third predetermined azimuth range and the azimuth in the front head direction of the listener may be smaller than the difference between the azimuth corresponding to the second predetermined azimuth range and the azimuth in the front head direction of the listener.

The processor may determine, based on the azimuth of the sound object with respect to the listener, mixing gains to be applied respectively to the object audio signal rendered using the first rendering method and the object audio signal rendered using the second rendering method.

The processor may use interpolation according to a change in the azimuth of the sound object with respect to the listener to determine the mixing gains to be applied respectively to the object audio signal rendered using the first rendering method and the object audio signal rendered using the second rendering method.

In accordance with another exemplary embodiment of the present invention, a method for operating an audio signal processing device for rendering audio signals includes: obtaining an input audio signal including an object audio signal; selecting at least one of a plurality of rendering methods based on an azimuth of a sound object with respect to a listener, corresponding to the object audio signal in a virtual space simulated by an output audio signal; rendering the object audio signal using a selected rendering method; and reproducing or transmitting the output audio signal including the rendered object audio signal.

The plurality of rendering methods may include a first rendering method and a second rendering method.

The rendering the object audio signal may include rendering the object audio signal using the first rendering method when the azimuth of the sound object with respect to the listener is within a first predetermined azimuth range, and rendering the object audio signal using the second rendering method when the azimuth of the sound object with respect to the listener is within a second predetermined azimuth range. Here, a difference between an azimuth corresponding to the first predetermined azimuth range and an azimuth in a front head direction of the listener may be smaller than a difference between an azimuth corresponding to the second predetermined azimuth range and the azimuth in the front head direction of the listener.

The first rendering method may require a higher calculation complexity compared to the second rendering method.

The first rendering method may be a head-related impulse response (HRIR)-based rendering method, and the second rendering method may be a panning-based rendering method.

According to the second rendering method, a plurality of sound objects may be modeled into one sound object based on a distance between the sound objects to perform rendering.

The first rendering method may cause less distortion in timbre compared to the second rendering method.

The first rendering method may be a panning-based rendering method, and the second rendering method is a HRIR-based rendering method.

The rendering the object audio signal further include rendering the object audio signal using the first rendering method and the second rendering method when the azimuth of the sound object with respect to the listener is within a third predetermined azimuth range, and generating the output audio signal by mixing an object audio signal rendered using the first rendering method and an object audio signal rendered using the second rendering method. A difference between an azimuth corresponding to the first predetermined azimuth range and the azimuth in the front head direction of the listener is smaller than a difference between an azimuth corresponding to the third predetermined azimuth range and the azimuth in the front head direction of the listener. Here, the difference between the azimuth corresponding to the third predetermined azimuth range and the azimuth in the front head direction of the listener is smaller than the difference between the azimuth corresponding to the second predetermined azimuth range and the azimuth in the front head direction of the listener.

The generating the output audio signal by mixing the object audio signal rendered using the first rendering method and the object audio signal rendered using the second rendering method may include determining, based on the azimuth of the sound object with respect to the listener, mixing gains to be applied respectively to the object audio signal rendered using the first rendering method and the object audio signal rendered using the second rendering method.

The determining the mixing gains may include using interpolation according to a change in the azimuth of the sound object with respect to the listener to determine the mixing gains to be applied respectively to the object audio signal rendered using the first rendering method and the object audio signal rendered using the second rendering method.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
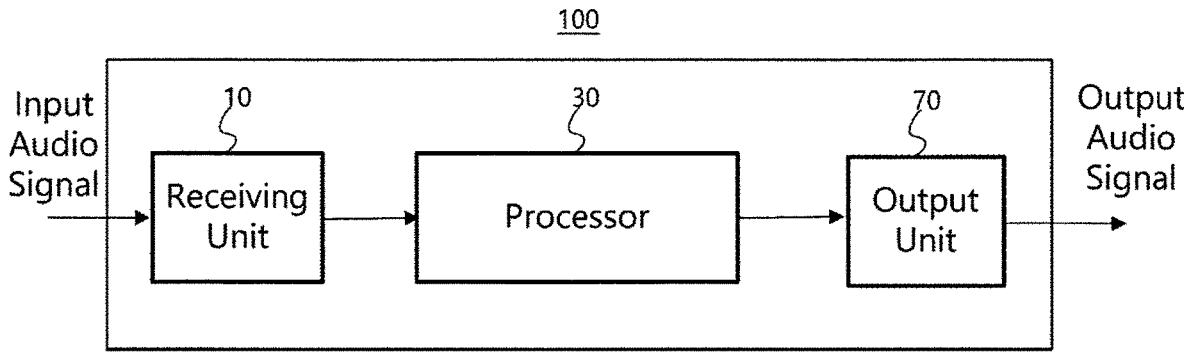
FIG. 1 is a block diagram illustrating an audio signal processing device for rendering an audio signal according to an embodiment of the present invention.

Hereinafter, embodiments of the present invention will be described in detail with reference to the accompanying drawings so that the embodiments of the present invention can be easily carried out by those skilled in the art. However, the present invention may be implemented in various different forms and is not limited to the embodiments described herein. Some parts of the embodiments, which are not related to the description, are not illustrated in the drawings in order to clearly describe the embodiments of the present invention. Like reference numerals refer to like elements throughout the description.

When it is mentioned that a certain part "includes", "comprises" or "has" certain elements, the part may further include other elements, unless otherwise specified.

FIG. 1 is a block diagram illustrating an audio signal processing device for rendering an audio signal according to an embodiment of the present invention.

An audio signal processing device 100 for rendering an audio signal according to an embodiment of the present invention includes a receiving unit 10, a processor 30, and an output unit 70.

The receiving unit 10 receives an input audio signal. Here, the input audio signal may be a signal obtained by converting a sound collected by a sound collecting device. The sound collecting device may be a microphone. Furthermore, the sound collecting device may be a microphone array including a plurality of microphones. The receiving unit 10 may be an audio signal input terminal. The receiving unit 10 may receive the audio signal transmitted wirelessly by using a Bluetooth or Wi-Fi communication method.

The processor 30 may control operation of the audio signal processing device 100. The processor 30 may control each component of the audio signal processing device 100. The processor 30 may perform an operation and processing on data and signals. The processor 30 may be implemented as hardware such as a semiconductor chip or an electronic circuit or may be implemented as software for controlling hardware. The processor 30 may be implemented in a form of a combination of hardware and software. For example, the processor 30 may execute at least one program to control operation of the receiving unit 10 and the output unit 70. In detail, the processor 30 processes the input audio signal received by the receiving unit 10.

In detail, the processor 30 may include at least one of a format converter, a renderer, or a post processor. The format converter converts a format of the input audio signal into another format. In detail, the format converter may convert an object signal into an ambisonics signal. Here, the ambisonics signal may be a signal recorded through a microphone array. Furthermore, the ambisonics signal may be a signal obtained by converting a signal recorded through a microphone array into a coefficient for a base of spherical harmonics. Furthermore, the format converter may convert the ambisonics signal into the object signal. In detail, the format converter may change an order of the ambisonics signal. For example, the format converter may convert a higher order ambisonics (HoA) signal into a first order ambisonics (FoA) signal. Furthermore, the format converter may obtain position information related to the input audio signal, and may convert the format of the input audio signal based on the obtained position information. Here, the position information may be information on a microphone array which has collected a sound corresponding to an audio signal. In detail, the information on the microphone array may include at least one of arrangement information, number information, position information, frequency characteristic information, or beam pattern information pertaining to microphones constituting the microphone array. Furthermore, the position information related to the input audio signal may include information indicating the position of a sound source.

The renderer renders the input audio signal. In detail, the renderer may render a format-converted input audio signal. Here, the input audio signal may include at least one of a loudspeaker channel signal, an object signal, or an ambisonics signal. In a specific embodiment, the renderer may use information indicated by an audio signal format to render the input audio signal into an audio signal that expresses the input audio signal as a virtual sound object positioned in a three-dimensional space. For example, the renderer may render the input audio signal in association with a plurality of loudspeakers. Furthermore, the renderer may binaurally render the input audio signal. The renderer may binaurally render the input audio signal in a frequency domain or time domain.

The renderer may binaurally render the input audio signal based on a transfer function pair. The transfer function pair may include at least one transfer function. For example, the transfer function pair may include one pair of transfer functions corresponding to two ears of a listener respectively. The transfer function pair may include an ipsilateral transfer function and a contralateral transfer function. In detail, the transfer function pair may include an ipsilateral head-related transfer function (HRTF) corresponding to a channel for an ipsilateral ear and a contralateral HRFT corresponding to a channel for a contralateral ear. Hereinafter, for convenience, the term "transfer function" (or HRTF) represents any one among the one or more transfer functions included in the transfer function (or HRTF) pair, unless otherwise specified.

The renderer may determine the transfer function pair based on a position of a virtual sound source corresponding to the input audio signal. Here, the processor 30 may obtain the transfer function pair from a device (not shown) other than the audio signal processing device 100. For example, the processor 30 may receive at least one transfer function from a database including a plurality of transfer functions. The database may be an external device for storing a transfer function set including a plurality of transfer functions. Here, the audio signal processing device 100 may include a separate communication unit (not shown) which requests a transfer function from the database, and receives information on the transfer function from the database. Alternatively, the processor 30 may obtain the transfer function pair corresponding to the input audio signal based on a transfer function set stored in the audio signal processing device 100. The processor 30 may generate an output audio signal by binaural-rendering the input audio signal based on the obtained transfer function pair.

Furthermore, the renderer may include a time synchronizer which synchronizes times of an object signal and an ambisonics signal.

Furthermore, the renderer may include a 6-degrees-of-freedom (6DOF) control unit which controls the 6DOF of an ambisonics signal. The 6DOF controller may include a direction modification unit which changes a magnitude of a specific directional component of an ambisonics signal. In detail, the 6DOF controller may change the magnitude of a specific directional component of an ambisonics signal according to the position of a listener in a virtual space simulated by an audio signal. The direction modification unit may include a directional modification matrix generator which generates a matrix for changing the magnitude of a specific directional component of an ambisonics signal. Furthermore, the 6DOF controller may include a conversion unit which converts an ambisonics signal into a channel signal, and may include a relative position calculation unit which calculates a relative position between a listener of an audio signal and a virtual loudspeaker corresponding to the channel signal.

The output unit 70 outputs a rendered audio signal. In detail, the output unit 70 may output an audio signal through at least two loudspeakers. In another specific embodiment, the output unit 70 may output an audio signal through a 2-channel stereo headphone. In detail, the output unit 70 may include an output terminal for externally outputting the output audio signal. Alternatively, the output unit 70 may include a wireless audio transmitting module for externally outputting the output audio signal. In this case, the output unit 70 may output the output audio signal to an external device by using a wireless communication method such as Bluetooth or Wi-Fi. Furthermore, the output unit 70 may further include a converter (e.g., digital-to-analog converter (DAC)) for converting a digital audio signal to an analog audio signal.

When a human being listens to a sound and determines the direction to the sound source, a minimum angle at which the human being is able to recognize a change of the direction of the sound is referred to as a minimum audible angle (MAA). The MAA may vary with the position of a sound source. Relevant descriptions will be provided with reference to FIG. 2.

Figure 2:
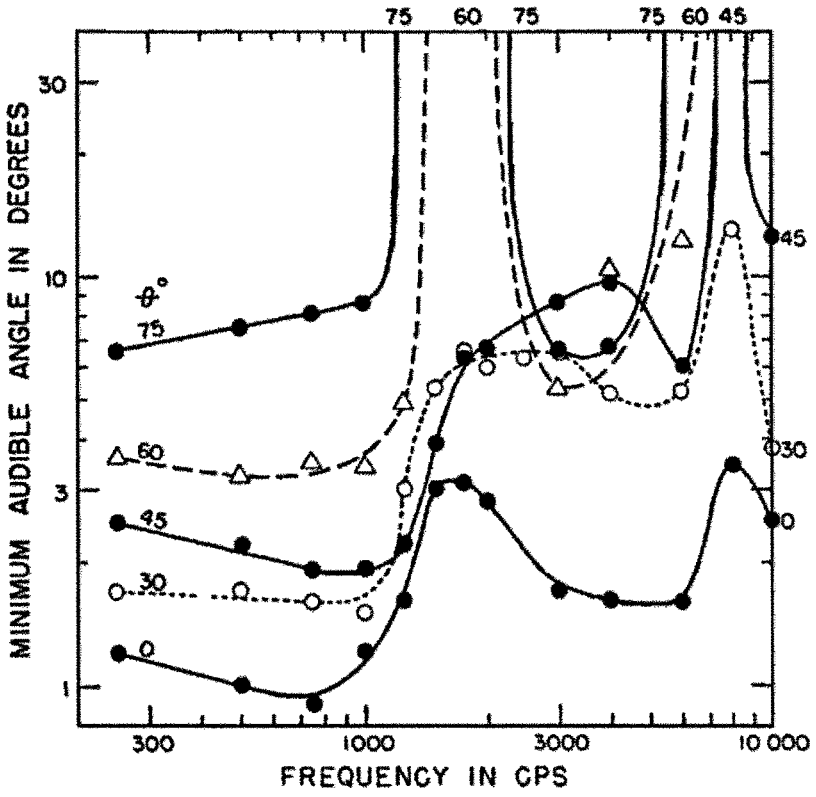
FIG. 2 illustrates a frequency of an audio signal and a minimum audible angle for a listener according to an azimuth of a sound source with respect to a listener, corresponding to the audio signal.

FIG. 2 illustrates a frequency of an audio signal and a minimum audible angle according to an azimuth of a sound source with respect to a listener corresponding to the audio signal.

Results of psychoacoustic researches indicate that a listener may best recognize a change in a sound output direction when the listener listens to a sound output from a sound source positioned in front of the listener. Therefore, a value of the MAA changes according to a magnitude of the azimuth with respect to the listener. Furthermore, the magnitude of the MAA may slightly vary with each person or each frequency band of an audio signal. From the graph of FIG. 2, it may be recognized that the MMA is at least about 1 degree and less than about 2 degrees when the frequency of the audio signal ranges from about 300 Hz (cps) to about 1000 Hz in the case where the azimuth is 0 degree or 30 degrees with respect to the listener. However, it may also be recognized that the MMA is at least about 3 degrees when the frequency of the audio signal ranges from about 300 Hz to about 1000 Hz in the case where the azimuth is 60 degree or 75 degrees with respect to the listener. Therefore, a listener may be insensitive to a position change or accuracy of a sound source when listening to a sound output from the sound source positioned in a rear of the listener.

The listener may be more sensitive to changes in timbre of a sound output from a sound source positioned in front of the listener than of a sound output from a sound source positioned in the rear of the listener. A visual cue recognizable by the listener is positioned in front of the listener. Therefore, the output direction of a sound recognizable by the listener and the sensitivity to timbre may change according to the position of a sound source which outputs the sound. For this reason, it is common practice to produce on the assumption that a sound source is positioned in front of the listener.

The audio signal processing device may binaurally render an audio signal in consideration of such auditory perception characteristics of a human being. In detail, the audio signal processing device may render an audio signal corresponding to a sound object by using at least one of a plurality of audio signal rendering methods based on the azimuth of the sound object with respect to the listener, reproducing a sound in a virtual space simulated by an output audio signal. In detail, the audio signal processing device may select at least one rendering method from among the plurality of rendering methods based on the azimuth of the sound object with respect to the listener and a predetermined azimuth range, and may render an object audio signal corresponding to the sound object according to the selected rendering method. For example, when the sound object is positioned in a forward direction, the audio signal processing device may render the object audio signal corresponding to the sound object by using a first rendering method. Furthermore, when the sound object is positioned in a backward direction, the audio signal processing device may render the object audio signal corresponding to the sound object by using a second rendering method.

The azimuth with respect to the listener may be a value measured based on a front direction of a head of the listener. In detail, the azimuth may be a value measured based on either the front direction of the head of the listener or both ears of the listener. The azimuth may be a value measured based on a field of view (FOV) of the listener. In detail, the azimuth may be a value measured based on either the field of view of the listener or both ears of the listener. Operation of the audio processing device will be described in more detail with reference to FIGS. 3 to 9.

A method for the audio signal processing device to binaurally render an object audio signal will be described before describing a specific operation method of the audio signal processing device. In the following description, the object audio signal refers to an audio signal corresponding to a specific sound object.

The audio signal processing device may render the object audio signal through head-related impulse response (HRIR)-based rendering. Here, the HRIR-based rendering may include rendering that uses a head-related transfer function (HRTF). The audio signal processing device may determine the HRTF to be used for rendering the object audio signal according to the position of the sound object. The position of the sound object may be expressed using an azimuth and elevation with respect to the listener. The audio signal processing device may accurately reproduce a sound delivered to both ears of the listener by using the HRIR-based rendering. The audio signal processing device may use the HRIR-based rendering rather than panning-based rendering to more accurately localize a sound image of the sound object. However, in the case where the audio signal processing device performs the HRIR-based rendering, it may be necessary to store in advance or generate the HRTF or HRIR for each position of the sound object simulated by the audio signal processing device. Therefore, the HRIR-based rendering which is performed by the audio signal processing device may require a higher complexity of processing than the panning-based rendering performed by the audio signal processing device.

The audio signal processing device may render the object audio signal through panning. The panning-based rendering will be described in detail with reference to FIG. 3.

Figure 3:
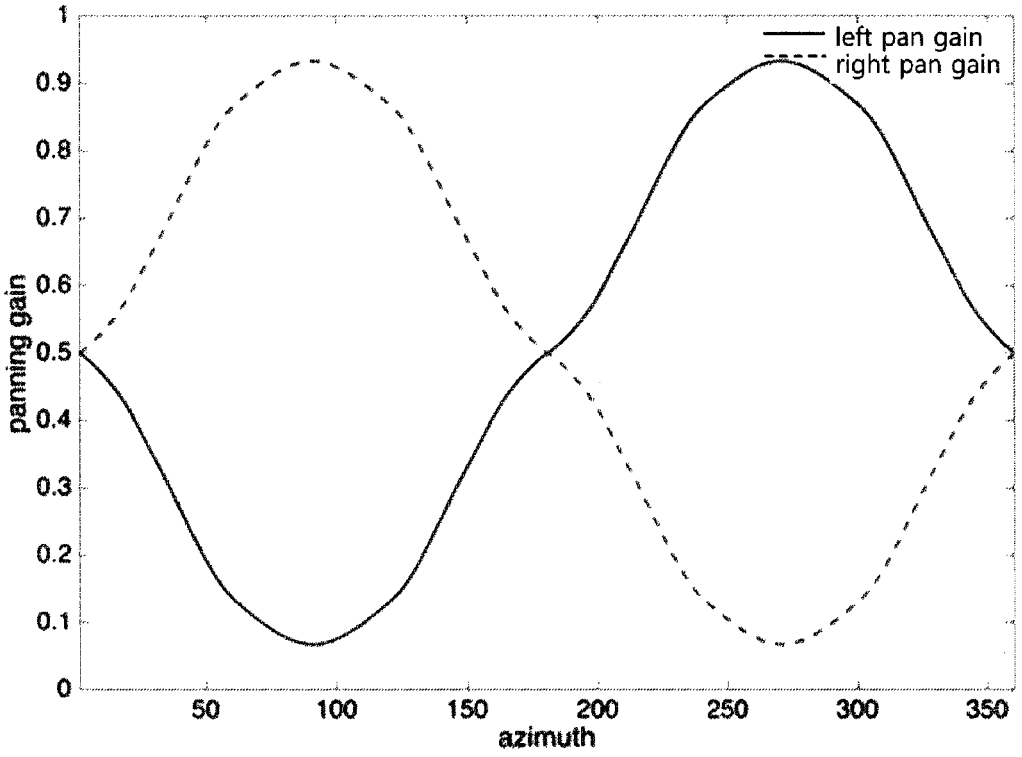
FIG. 3 illustrates a panning gain of an audio signal rendered based on interactive panning when the audio signal processing device according to an embodiment of the present invention combines an audio signal rendered using an HRTF and an audio signal rendered based on the interactive panning.

FIG. 3 illustrates a panning gain of an audio signal rendered based on interactive panning when the audio signal processing device according to an embodiment of the present invention combines an audio signal rendered using the HRTF and the audio signal rendered based on the interactive panning.

The audio signal processing device may pan a plurality of object signals corresponding to a plurality of sound object to generate an audio signal mapped to a virtual loudspeaker layout. Here, the audio signal processing device may render the audio signal generated using the HRTF corresponding to the virtual loudspeaker layout. Since all of the audio signal components are mapped to the virtual loudspeaker layout even if the number of sound objects increases, the number of convolution calculations performed by the audio signal processing device may be limited to the number of loudspeakers of the virtual loudspeaker layout. Furthermore, the audio signal processing device may perform rendering only using the HRTFs corresponding to the number of loudspeakers of the virtual loudspeaker layout. Therefore, it is sufficient for the audio signal processing device to store in advance or calculate and generate the HRTFs equivalent to the number of loudspeakers of the virtual loudspeaker layout.

In another specific embodiment, the audio signal processing device may render the object audio signal by adjusting magnitudes of left and right panning gains of an audio signal according to a change in the azimuth of the sound object relative to the listener. This operation may be referred to as interactive panning. In the case where the audio signal processing device uses the interactive panning, the audio signal processing device may quickly respond to the change in the azimuth of the sound object relative to the listener through a processing of relatively low complexity. In the case of a device such as a HMD on which change of a head direction of a user frequently occurs, the interactive panning may be usefully used. However, it may be difficult for the audio signal processing device to reproduce a sound image positioned in the front or rear of the listener by using the panning-based rendering. Therefore, it may be more difficult for the audio signal processing device to accurately localize the sound image of the sound object when using the panning-based rendering than when using the HRIR-based rendering.

The audio signal processing device may combine, in a time domain or frequency domain, an audio signal rendered through the HRIR-based rendering and an audio signal rendered through the interactive panning-based rendering. Here, when the audio signal processing device combines the two audio signals without considering phases of the two audio signals, the phases of the two audio signals may not match. Therefore, timbre distortion may occur due to a comb-filtering effect. In order to prevent this effect, the audio signal processing device may interpolate the magnitude and phase of the HRIR-rendered audio signal in a frequency band and the magnitude and phase of the interactive-panned audio signal in a frequency band. Here, a panning gain ratio the interactive-panned audio signal may be determined based on energy of the HRTF. In detail, the audio signal processing device may determine the panning gain ratio of the interactive-panned audio signal based on the following equation.

$$p_L+p_R=1,$$

$$p_L=H_\text{mean}L(a)/(H_\text{mean}L(a)+H_\text{mean}R(a)),$$

$$p_R=H_\text{mean}R(a)/(H_\text{mean}L(a)+H_\text{mean}R(a)),$$

where $H_\text{mean}L(a)=\text{mean}(\text{abs}(H_L(k)))$, and $$H_\text{mean}R(a)=\text{mean}(\text{abs}(H_R(k)))$$

Here, each of p_L and p_R denotes a ratio of a panning gain applied to the interactive panning. Furthermore, 'a' denotes an index indicating an azimuth in an interaural polar coordinate (IPC) region. 'k' denotes an index indicating a frequency bin. H_L(k) and H_R(k) respectively denote frequency responses of HRTF corresponding to a left ear and a right ear. Furthermore, mean(x) denotes a mean value of x. Furthermore, abs(x) denotes an absolute value of x.

The audio signal processing device may interpolate the magnitude and phase of the HRIR-rendered audio signal in a frequency band and the magnitude and phase of the interactive-panned audio signal in a frequency band based on the following equation.

$$BES_\text{hat}=\text{IFFT}[g_H\cdot mag\{S(k)\}\cdot mag\{H_L,R(k)\}\cdot pha\{S(k)+H_L,R(k)\}+g_I\cdot mag\{S(k)\}\cdot mag\{P_L,R(k)\}\cdot pha\{S(k)+P_L,R(k)\}$$

Here, mag{•} denotes a magnitude for a frequency response. pha{•} denotes a phase for a frequency response. S(k) is a frequency domain expression of input signal s(n), and H_L,R(k) is a frequency domain expression of a left or right HRIR. Furthermore, g_H and g_I are gains indicating interpolation ratios of the interactive panning, and P_L,R(k) denotes a left- or right-side channel panning gain.

Described below with reference to FIGS. 4 to 9 is a method for the audio signal processing device to render an audio signal by using at least one of a plurality of audio signal rendering methods based on the azimuth of the sound object with respect to the listener, reproducing a sound in a virtual space simulated by an output audio signal.

Figure 4:
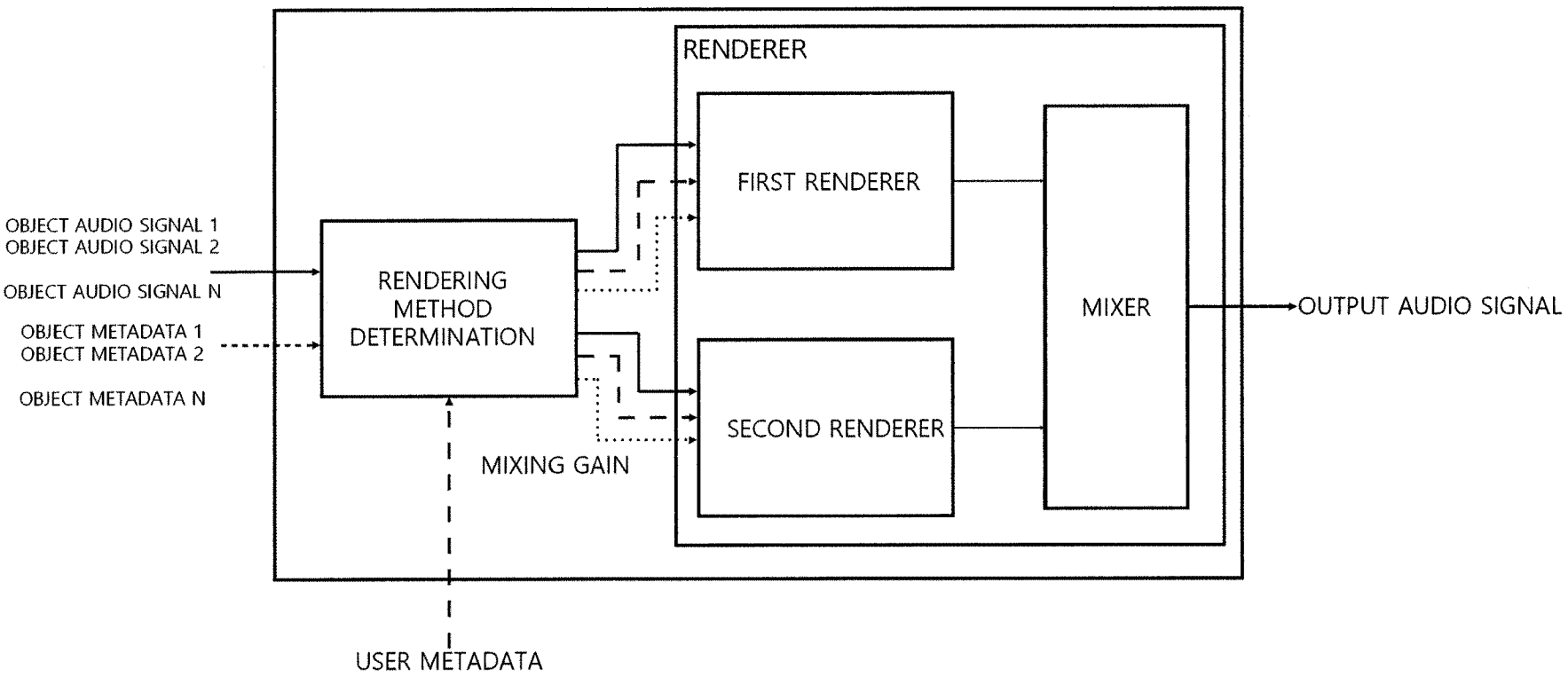
FIG. 4 is a block diagram illustrating a processor included in the audio signal processing device according to an embodiment of the present invention.

FIG. 4 is a block diagram illustrating a processor included in the audio signal processing device according to an embodiment of the present invention.

The audio signal processing device may render an audio signal by using at least one of the plurality of audio signal rendering methods based on the azimuth of the sound object with respect to the listener in the virtual space simulated by the output audio signal.

The processor may include a rendering method determination processor and a renderer. The rendering method determination processor may determine a rendering method to be used for an object audio signal corresponding to a sound object based on the azimuth of the sound object with respect to the listener. In detail, the rendering method determination processor may obtain the azimuth with respect to the listener based on metadata indicating information on the object audio signal and user metadata indicating information on a user. Here, the user metadata may include information indicating at least one of a head direction of the user or a viewing direction of the user. The user metadata may be updated in real time according to a movement of the user. Furthermore, the object metadata may include information indicating coordinates of the sound object corresponding to the object audio signal. The object metadata may include information on a direction and distance. Here, the information on a direction may include information indicating an elevation and information indicating an azimuth.

Furthermore, the audio signal processing device may simultaneously use a plurality of rendering methods to combine and output audio signals rendered using the plurality of rendering methods respectively according to the azimuth of the sound object with respect to the listener. Here, the audio signal processing device may determine a mixing gain to be applied to the audio signals rendered using the plurality of rendering methods respectively according to the azimuth of the sound object with respect to the listener. The audio signal processing device may determine a mixing gain to be applied to the audio signals rendered using the plurality of rendering methods respectively based on the azimuth of the sound object with respect to the listener.

The renderer may render the object audio signal according to a rendering method determined by the rendering method determination unit. The renderer may include a plurality of renderers. In detail, the renderer may include a first renderer for rendering the object audio signal according to a first rendering method and a second renderer for rendering the object audio signal according to a second rendering method.

The renderer may include a mixer. The mixer may generate an output audio signal by mixing the audio signals rendered by the plurality of renderers respectively. Here, the mixer may mix the audio signals respectively rendered by the plurality of renderers, according to the mixing gain determined by the rendering method determination unit.

Criteria for determining a rendering method by an audio signal processing device will be described with reference to FIGS. 5 and 6.

Figure 5:
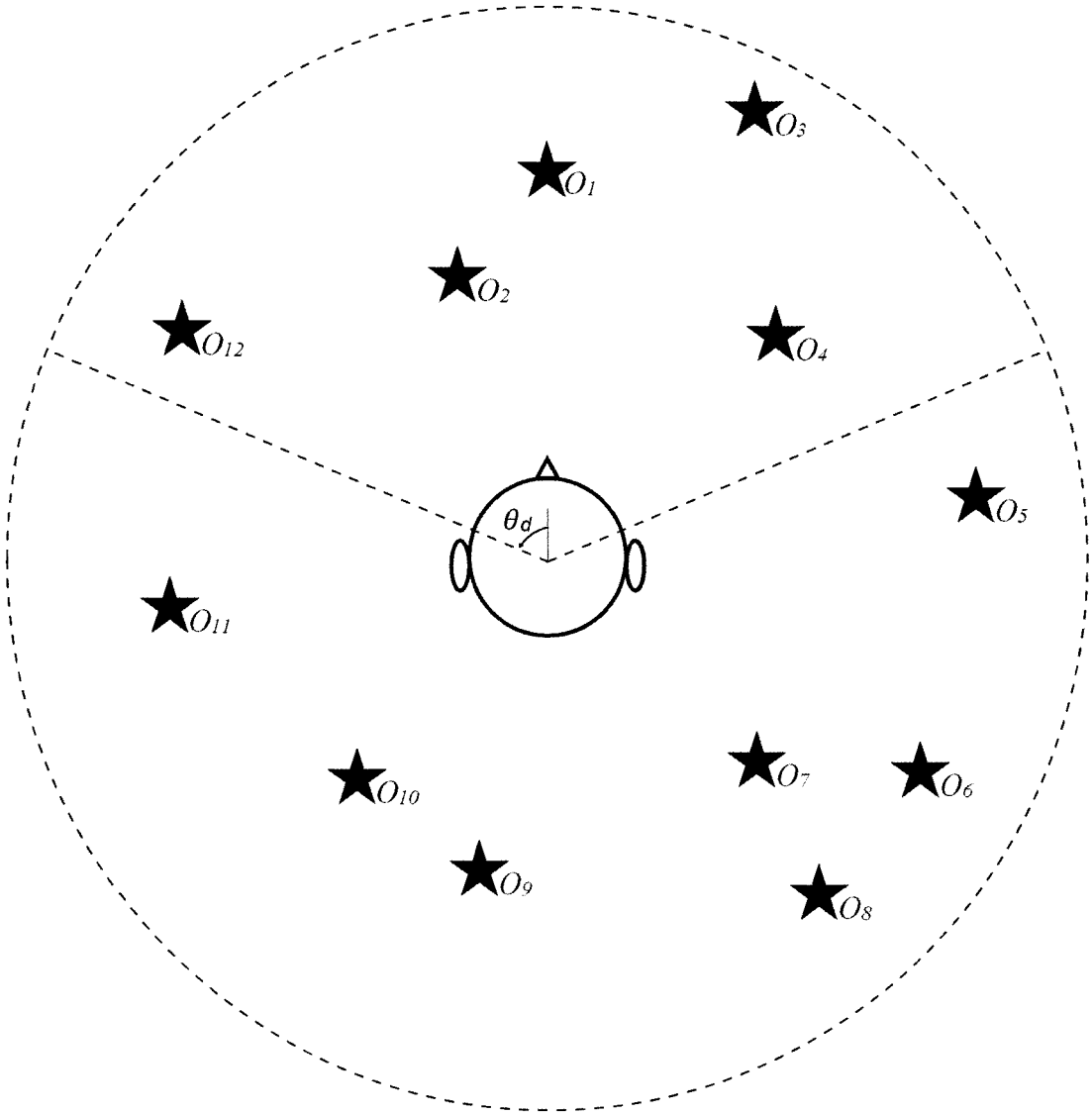
FIG. 5 illustrates a method for the audio signal processing device according to an embodiment of the present invention to select a rendering method for an object audio signal corresponding to a sound object by dividing a range of an azimuth of a sound object with respect to a listener into two ranges.

FIG. 5 illustrates a method for the audio signal processing device according to an embodiment of the present invention to select a rendering method for an object audio signal corresponding to a sound object by dividing a range of the azimuth of the sound object with respect to a listener into two ranges.

The audio signal processing device may select at least one rendering method from among a plurality of rendering methods based on the azimuth of the sound object with respect to the listener and a predetermined azimuth range, and may render the object audio signal corresponding to the sound object according to the selected rendering method. The plurality of audio signal rendering methods may include a first rendering method and a second rendering method. Here, when the sound object is positioned in a forward direction, the audio signal processing device may render the object audio signal corresponding to the sound object by using the first rendering method. In a specific embodiment, when the azimuth of the sound object with respect to the listener is within the predetermined azimuth range, the audio signal processing device may render the object audio signal corresponding to the sound object by using a first rendering method. Here, when the azimuth of the sound object with respect to the listener is outside the predetermined azimuth range, the audio signal processing device may render the object audio signal corresponding to the sound object by using the second rendering method. In these embodiments, the predetermined azimuth range may be positioned in front of the listener. In detail, the predetermined azimuth range may be a set of azimuths having a difference of less than predetermined value with respect to the azimuth in a front head direction of the listener. In a specific embodiment, the predetermined azimuth range may belong to the set of azimuths having a difference of less than 90 degrees with respect to the azimuth in the front head direction of the listener.

In the embodiment of FIG. 5, the audio signal processing device receives object audio signals corresponding to first object $O_1$ to 12th object $O_{12}$. A sound object having an azimuth with respect to the listener, which is within a predetermined angle $\theta_d$ includes the first object $O_1$, the second object $O_2$, the third object $O_3$, the fourth object O4, and the 12th object $O_{12}$. The audio signal processing device renders the object audio signals respectively corresponding to the first object $O_1$, the second object $O_2$, the third object $O_3$, the fourth object $O_4$, and the 12th object $O_{12}$ by using the first rendering method. Furthermore, the audio signal processing device renders the object audio signals corresponding to the other sound objects by using the second rendering method.

Figure 6:
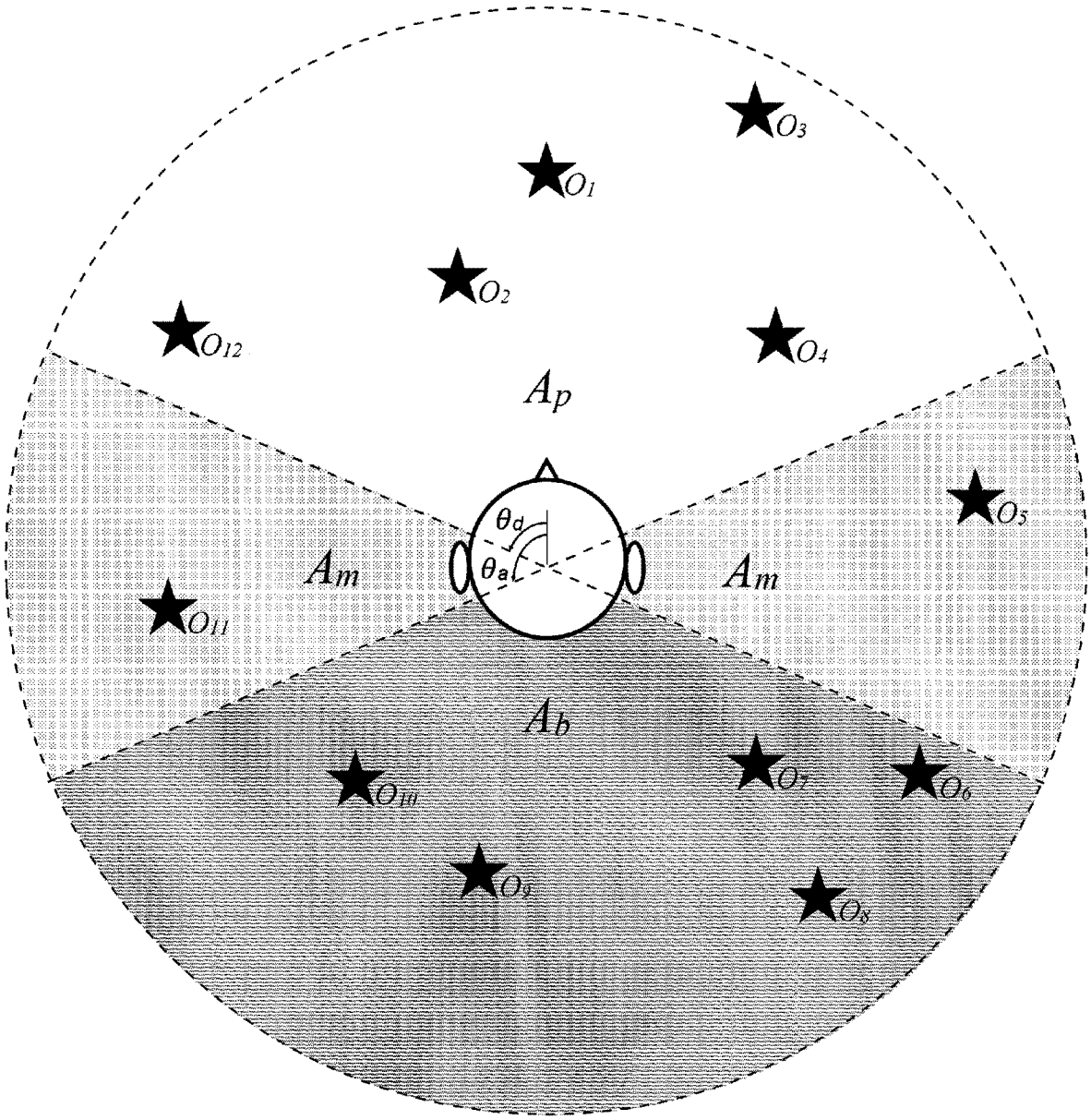
FIG. 6 illustrates a method for the audio signal processing device according to an embodiment of the present invention to select a rendering method for an object audio signal corresponding to a sound object by dividing a range of a n azimuth of a sound object with respect to a listener into three ranges.

FIG. 6 illustrates a method for the audio signal processing device according to an embodiment of the present invention to select a rendering method for an object audio signal corresponding to a sound object by dividing a range of the azimuth of the sound object with respect to the listener into three ranges.

When the azimuth of the sound object with respect to the listener is within the predetermined azimuth range, the audio signal processing device may render an object audio signal corresponding to a sound object by using the first rendering method, and may render the object audio signal by using the second rendering method. Here, the audio signal processing device may generate an output audio by mixing the audio signal rendered using the first rendering method and the audio signal rendered using the second rendering method. In detail, the audio signal processing device may determine, according to the azimuth of the sound object with respect to the listener, mixing gains to be respectively applied to the audio signal rendered using the first rendering method and the audio signal rendered using the second rendering method, and may mix the audio signal rendered using the first rendering method and the audio signal rendered using the second rendering method according to the determined mixing gains. Here, the audio signal processing device may mix the audio signal rendered using the first rendering method and the audio signal rendered using the second rendering method at different ratios according to the azimuth of the sound object with respect to the listener. When the azimuth of the sound object with respect to the listener is within a first azimuth range, the audio signal processing device may render the object audio signal corresponding to the sound object by using the first rendering method to generate the output audio signal. In detail, the first azimuth range may be a set of azimuths having a difference of less than predetermined first value with respect to the azimuth in the front head direction of the listener. In a specific embodiment, the first azimuth range may belong to the set of azimuths having a difference of less than 90 degrees with respect to the azimuth in the front head direction of the listener. When the azimuth of the sound object with respect to the listener is within a second azimuth range, the audio signal processing device may render the corresponding object audio signal by using the second rendering method to generate the output audio signal. In detail, the second azimuth range may be a set of azimuths having a difference that is larger than the predetermined first value and less than a predetermined second value with respect to the azimuth in the front head direction of the listener. Here, the predetermined first value may be equal to or smaller than the predetermined second value. The difference between every azimuth corresponding to the first azimuth range and the azimuth in the front head direction of the listener may be smaller than the difference between every azimuth corresponding to the second azimuth range and the azimuth in the front head direction of the listener. When the azimuth of the sound object with respect to the listener is within a third azimuth range, the audio signal processing device may render the corresponding object audio signal by using the first rendering method, and may render the object audio signal by using the second rendering method. Here, the third azimuth range may be a set of azimuths having a difference that is larger than a predetermined third value and less than the predetermined second value with respect to the azimuth in the front head direction of the listener. Here, the predetermined third value may be equal to or smaller than the predetermined second value. The difference between the azimuths corresponding to the first azimuth range and the azimuth in the front head direction of the listener may be smaller than the difference between the azimuths corresponding to the third azimuth range and the azimuth in the front head direction of the listener. Furthermore, the difference between every azimuth corresponding to the third azimuth range and the azimuth in the front head direction of the listener may be smaller than the difference between every azimuth corresponding to the second azimuth range and the azimuth in the front head direction of the listener. The audio signal processing device may generate the output audio by mixing the audio signal rendered using the first rendering method and the audio signal rendered using the second rendering method. In detail, when the azimuth of the sound object with respect to the listener is within the third azimuth range, the audio signal processing device may mix the audio signal rendered using the first rendering method and the audio signal rendered using the second rendering method by using interpolation according to a change in the azimuth of the sound object. In another specific embodiment, when the azimuth of the sound object with respect to the listener is within the third azimuth range, the audio signal processing device may generate the output audio signal by mixing, according to a predetermined mixing gain, the audio signal obtained by rendering the object audio signal corresponding to the sound object by using the first rendering method and the audio signal obtained by rendering the object audio signal corresponding to the sound object by using the second rendering method. In another specific embodiment, when the azimuth of the sound object with respect to the listener is within the third azimuth range, the audio signal processing device may generate the output audio signal by mixing audio signals rendered using a third rendering method.

When a rendering method is changed due to rapid change of the azimuth of the sound object with respect to the listener, the audio signal processing device may switch a rendering method by using at least one of fade-in or fade-out during a predetermined time period. In detail, when a rendering method is changed due to rapid change of the azimuth of the sound object with respect to the listener, the audio signal processing device may fade in an audio signal rendered using a new rendering method and may fade out an audio signal rendered using a previous rendering method during the predetermined time period. The predetermined time period may be a previous audio frame and a current audio frame. Through these embodiments, the present invention may prevent side effects that may occur due to rapid change of the output audio signal when the head direction of the user rapidly changes or the sound object suddenly moves.

In the embodiment of FIG. 6, the audio signal processing device renders the object audio signals corresponding to the first object $O_1$ to 12th object $O_{12}$ respectively. Here, a first region is a set of coordinates at which the magnitude of the azimuth is within a first predetermined angle $\theta_d$. When the sound object is positioned within a first region $A_p$, the audio signal processing device renders an object audio signal corresponding to the sound object by using the first rendering method. The audio signal processing device renders the object audio signals respectively corresponding to the first object $O_1$, the second object $O_2$, the third object $O_3$, the fourth object $O_4$, and the 12th object $O_{12}$ by using the first rendering method. When the sound object is positioned within a second region $A_b$, the audio signal processing device renders a corresponding object audio signal by using the second rendering method. Here, the second region is a set of coordinates at which the magnitude of the azimuth is larger than a second predetermined angle $\theta_a$. The audio signal processing device renders the object audio signals respectively corresponding to sixth object $O_6$, the seventh object $O_7$, the eighth object $O_8$, the ninth object $O_9$, and the 10th object $O_{10}$ by using the second rendering method. When the sound object is positioned within a third region $A_m$, the audio signal processing device renders a corresponding object audio signal by using the first rendering method, and renders the object audio signal by using the second rendering method. The audio signal processing device generates the output audio by mixing the audio signal rendered using the first rendering method and the audio signal rendered using the second rendering method. Here, the third region is a set of coordinates at which the magnitude of the azimuth is larger than the first predetermined angle $\theta_d$ and less than the second predetermined angle $\theta_a$. The audio signal processing device renders the object audio signals respectively corresponding to the 11th object $O_{11}$ and the fifth object $O_5$ by using the first rendering method and renders the object audio signals by using the second rendering method, and mixes the rendered audio signals.

The first rendering method and the second rendering method used in the above-mentioned embodiments will be described in detail with reference to FIGS. 7 to 9.

Figure 7:
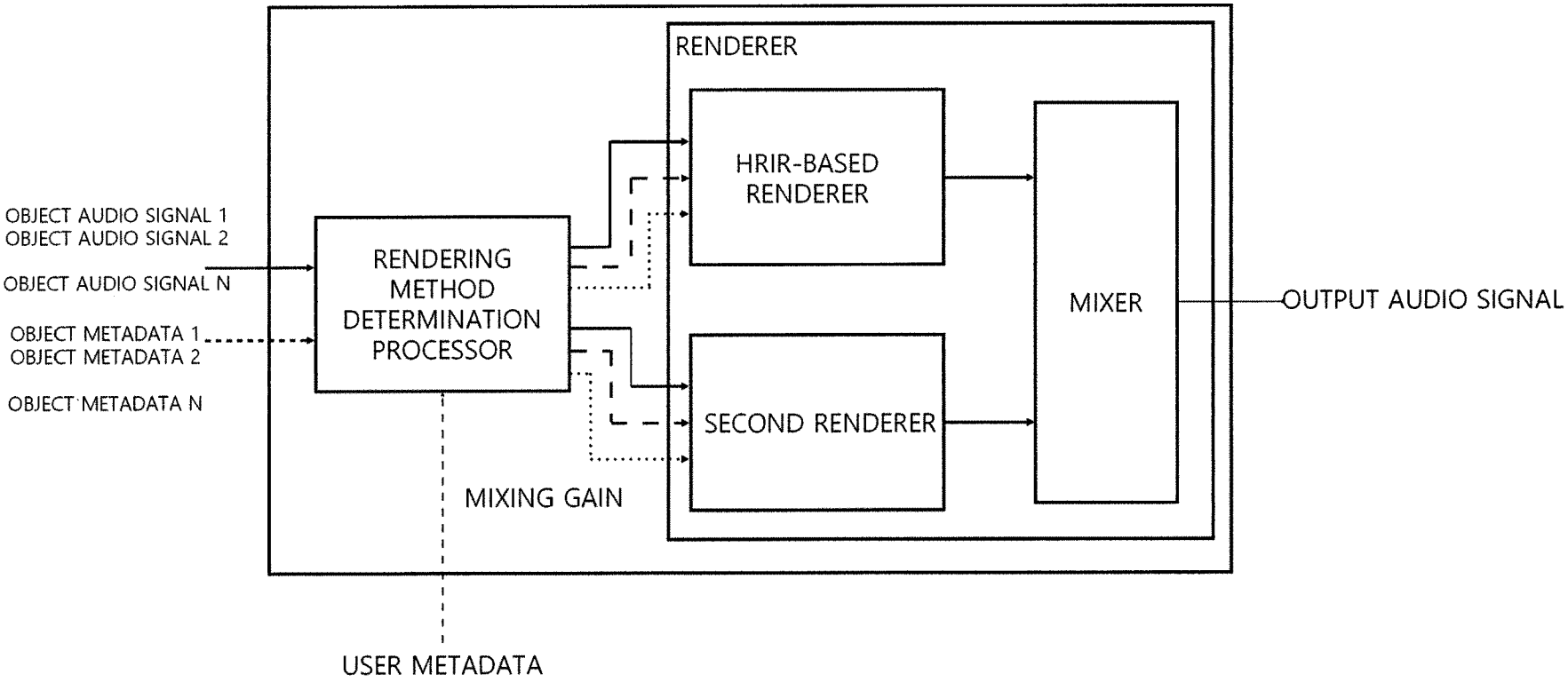
FIG. 7 is a block diagram illustrating a processor included in the audio signal processing device according to an embodiment of the present invention.

FIG. 7 is a block diagram illustrating a processor included in the audio signal processing device according to an embodiment of the present invention.

The first rendering method may be one that requires a higher complexity of processing in comparison with the second rendering method. In detail, the first rendering method may be a HRIR-based rendering method. In FIG. 7, a renderer includes a HRIR-based renderer and a second renderer. Here, the second renderer may perform rendering according to a rendering method that requires a lower complexity of processing than the HRIR-based renderer. Other configurations of the processor of FIG. 7 are the same as the processor of FIG. 4.

In a specific embodiment, the second rendering method may be the above-mentioned panning-based rendering method. Relevant descriptions with be provided with reference to FIG. 8.

Figure 8:
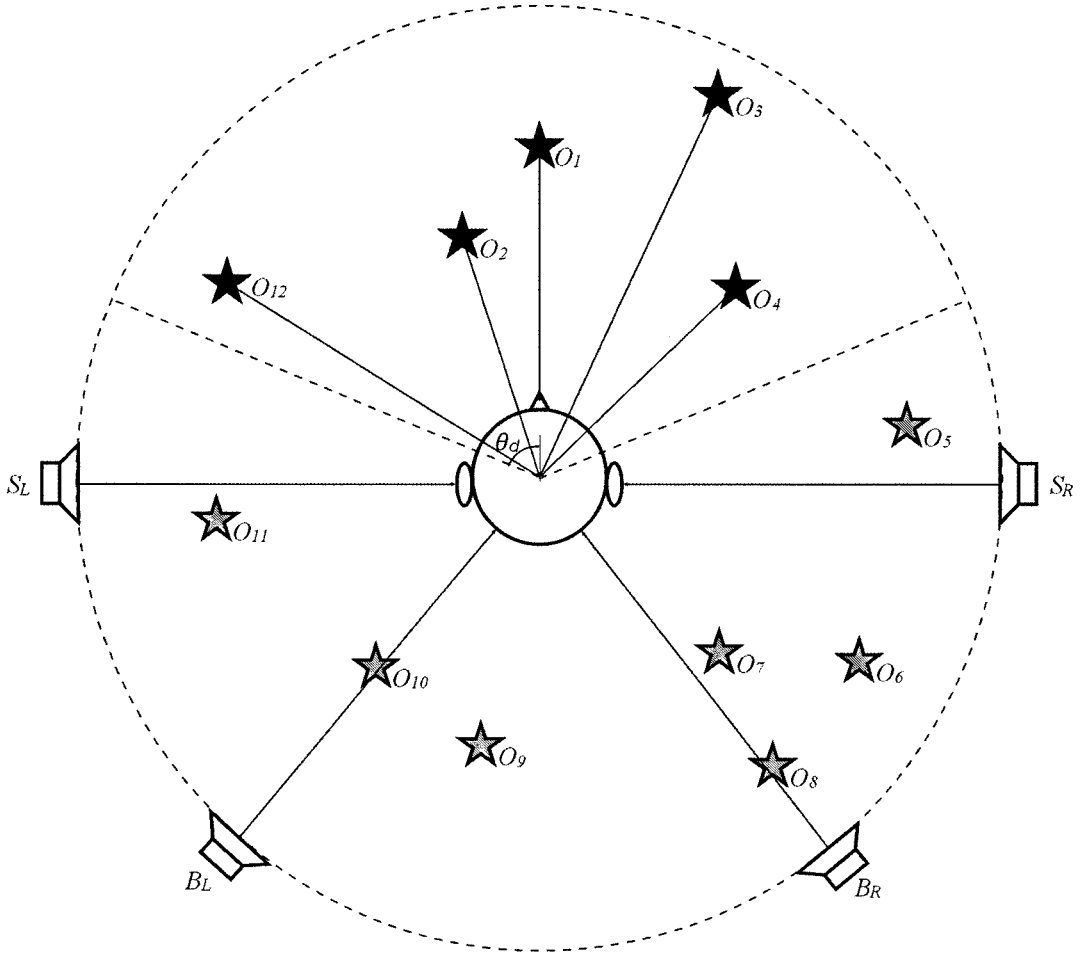
FIG. 8 illustrates that the audio signal processing device according to an embodiment of the present invention renders an audio signal using an HRIR-based rendering method and a panning-based rendering method.

FIG. 8 illustrates that the audio signal processing device according to an embodiment of the present invention renders an audio signal using the HRIR-based rendering method and the panning-based rendering method.

In the embodiment of FIG. 8, the audio signal processing device receives the object audio signals corresponding to the first object $O_1$ to 12th object $O_{12}$ respectively. A sound object having an azimuth with respect to a listener, which is within the predetermined angle $\theta_d$ includes the first object $O_1$, the second object $O_2$, the third object $O_3$, the fourth object $O_4$, and the 12th object $O_{12}$. The audio signal processing device renders the object audio signals respectively corresponding to the first object $O_1$, the second object $O_2$, the third object $O_3$, the fourth object $O_4$, and the 12th object $O_{12}$ by using the HRIR-based rendering. Furthermore, the audio signal processing device renders the object audio signals corresponding to the other sound objects by using the panning-based rendering. In detail, the audio signal processing device pans the object audio signals to generate audio signals mapped to loudspeakers $S_L$, $S_R$, $B_L$, and $B_R$ having a predetermined layout. The audio signal processing device renders the generated audio signals by using the HRTFs respectively corresponding to the loudspeakers $S_L$, $S_R$, $B_L$, and $B_R$ having the predetermined layout. For convenience, the loudspeakers having the predetermined layout are expressed as virtual loudspeaker channels arranged on a two-dimensional plane.

However, the loudspeakers having the predetermined layout may correspond to three loudspeaker pairs in a three-dimensional space. Therefore, the panning-based rendering method may include panning based on vector based amplitude panning (VBAP). Compared to the processing complexity required for performing HRTF convolution, the processing complexity required for obtaining the panning gain of an object audio may approximate to 0. In the embodiment of FIG. 8, the audio signal processing device applies the HRTF to each of five object audio signals and audio signals corresponding to four loudspeakers rather than applying the HRTF to each of the 12 object audio signals. Therefore, in the embodiment of FIG. 8, the processing complexity of the audio signal processing device may reduce by about 25%.

In another specific embodiment, the second rendering method may be a method in which a plurality of sound objects are regarded as one sound object to perform rendering. Relevant descriptions will be provided with reference to FIG. 9.

Figure 9:
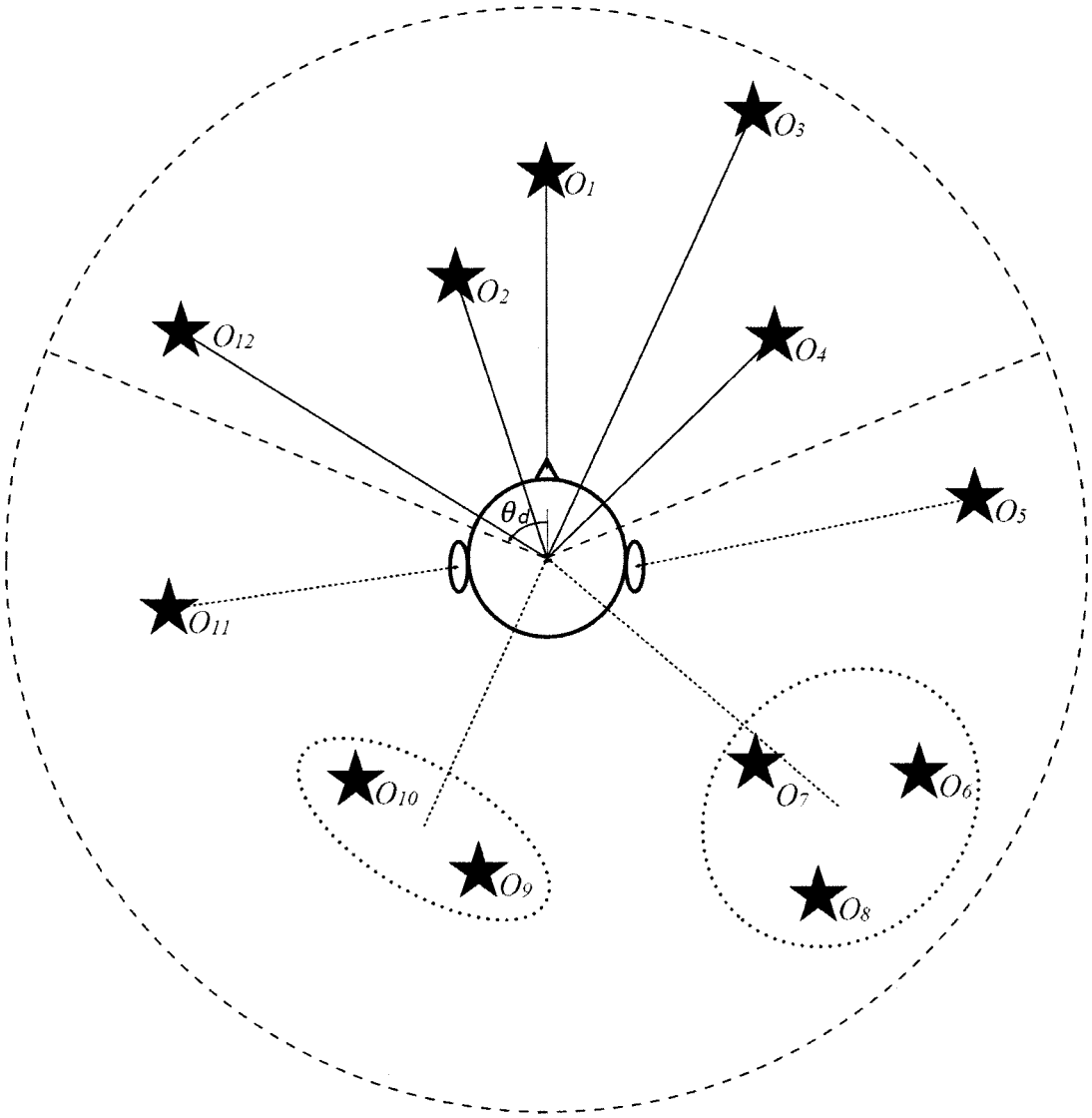
FIG. 9 illustrates that the audio signal processing device according to an embodiment of the present invention performs rendering by regarding a plurality of sound objects as one sound object according to an azimuth of a sound object with respect to a listener.

FIG. 9 illustrates that the audio signal processing device according to an embodiment of the present invention performs rendering by regarding a plurality of sound objects as one sound object according to the azimuth of a sound object with respect to the listener.

When the azimuth of the sound object with respect to the listener, falls within the second azimuth range, the audio signal processing device may model a plurality of sound objects into one sound object to perform rendering. Here, the modeling may represent that the audio signal processing device converts a plurality of sound objects into one representative sound object. Furthermore, the modeling may be referred to as mixing. In detail, when the azimuth of the sound object with respect to the listener falls within the second azimuth range, the audio signal processing device may model a plurality of sound objects into one sound object based on a distance between the sound objects to perform rendering. For convenience, when plurality of sound objects are regarded as one sound object, the plurality of sound objects are referred to as a cluster. In a specific embodiment, the audio signal processing device may map object audio signals corresponding to sound objects within a cluster to at least one point within the cluster by using a panning technique. Here, the audio signal processing device may render the object audio signals mapped to at least one point within the cluster. In detail, the audio signal processing device may render the mapped object audio signals by using the HRTF corresponding to the at least one point within the cluster. Furthermore, the audio signal processing device may render the mapped object audio signals by using an interactive panning technique. When an azimuth of the sound object with respect to a user, changes in real time, the number or position of each cluster or object audio signals mapped to a cluster may change in real time. Here, the azimuth of the sound object may be changed according to a change of the position of the sound object or the head direction of the user. In detail, when the azimuth of the sound object with respect to the user changes, the audio signal processing device may re-determine at least one of the number of clusters or the positions thereof. In a specific embodiment, when the change in the azimuth of the sound object with respect to the user is larger than a predetermined angle, the audio signal processing device may re-determine at least one of the number of clusters or the positions thereof.

The audio signal processing device may select, based on the azimuth of each sound object with respect to the listener, sound objects to be rendered as one cluster from among a plurality of sound objects. The audio signal processing device may select the sound objects to be rendered as one cluster based on a MAA range. In detail, the audio signal processing device may render sound objects present within the MAA range from a certain specific azimuth as one cluster. Furthermore, the audio signal processing device may select, based on a threshold of the number of clusters, sound objects to be rendered as one cluster from among a plurality of sound objects. Furthermore, the audio signal processing device may use K-means clustering to select sound objects to be rendered as one cluster from among a plurality of sound objects.

In the embodiment of FIG. 9, the audio signal processing device receives the object audio signals corresponding to the first object $O_1$ to 12th object $O_{12}$ respectively. A sound object having an azimuth with respect to a listener, which is within the predetermined angle $\theta_d$ includes the first object $O_1$, the second object $O_2$, the third object $O_3$, the fourth object $O_4$, and the 12th object $O_{12}$. The audio signal processing device renders the object audio signals respectively corresponding to the first object $O_1$, the second object $O_2$, the third object $O_3$, the fourth object $O_4$, and the 12th object $O_{12}$ by using the HRIR-based rendering. Furthermore, the audio signal processing device clusters and renders a plurality of sound objects outside the predetermined angle $\theta_d$. A sound object having an azimuth with respect to a listener, which is outside the predetermined angle $\theta_d$ includes the fifth object $O_5$, the sixth object $O_6$, the seventh object $O_7$, the eighth object $O_8$, the ninth object $O_9$, the 10th object $O_{10}$, and the 11th object $O_{11}$. The audio signal processing device renders the ninth object $O_9$ and the 10th object $O_{10}$ as one cluster. Furthermore, the audio signal processing device renders object audio signals corresponding to the sixth object $O_6$, the seventh object $O_7$, and the eighth object $O_8$. The audio signal processing device renders the ninth object $O_9$ and the 10th object $O_{10}$ as one cluster.

In another specific embodiment, both the first rendering method and the second rendering method may use the HRTF. Here, the number of filter coefficients of HRTF used in the first rendering method may be larger than the number of filter coefficients of HRTF used in the second rendering method.

Through these embodiments, the audio signal processing device may not reduce the accuracy of the position of a sound object recognized by the listener while reducing the computation complexity.

In another specific embodiment, the first rendering method may cause less distortion in timbre in comparison with the second rendering method. For example, the first rendering method may be a panning-based rendering method. In this case, the second rendering method may be a HRIR-based rendering method. This is because the listener may be more sensitive to changes in timbre or direction of a sound output from a front sound object as described above.

In the above-mentioned embodiments, the predetermined azimuth range which is a criterion for setting a rendering method may be set according to personal auditory characteristics. This is because each person may have a different MAA.

In the above-mentioned embodiments, the azimuth may be replaced with an elevation angle or solid angle. In detail, the audio signal processing device may render an object audio signal corresponding to a sound object by using at least one of a plurality of audio signal rendering methods based on an elevation angle or solid angle of the sound object with respect to the listener. In detail, the audio signal processing device may select at least one rendering method from among the plurality of rendering methods based on the elevation angle or solid angle of the sound object with respect to the listener and a predetermined angle range, and may render the object audio signal corresponding to the sound object according to the selected rendering method.

Although the present invention has been described using the specific embodiments, those skilled in the art could make changes and modifications without departing from the spirit and the scope of the present invention. That is, although the embodiments for processing multi-audio signals have been described, the present invention can be equally applied and extended to various multimedia signals including not only audio signals but also video signals. Therefore, any derivatives that could be easily inferred by those skilled in the art from the detailed description and the embodiments of the present invention should be construed as falling within the scope of right of the present invention.

Embodiments of the present invention provide an audio signal processing method and device for processing a plurality of audio signals.

More specifically, embodiments of the present invention provide an audio signal processing method and device for processing an audio signal which may be expressed as an ambisonics signal.

What is claimed is:

1. An audio signal processing device for rendering audio signals, the audio signal processing device comprising:

a processor configured to:

obtain an input audio signal comprising an object audio signal, render the object audio signal using a first rendering method when an azimuth of a sound object with respect to a listener is within a first predetermined azimuth range, render the object audio signal using a second rendering method when the azimuth of the sound object with respect to the listener is within a second predetermined azimuth range, wherein a difference between every azimuth corresponding to the first predetermined azimuth range and an azimuth in a front head direction of the listener is smaller than a difference between every azimuth corresponding to the second predetermined azimuth range and the azimuth in the front head direction of the listener, and output an output audio signal comprising the object audio signal rendered using the first or second rendering method.

2. The audio signal processing device of claim 1, wherein the first rendering method requires a higher processing complexity compared to the second rendering method.

3. The audio signal processing device of claim 2, wherein the first rendering method is a head-related impulse response (HRIR)-based rendering method, and the second rendering method is a panning-based rendering method.

4. The audio signal processing device of claim 2, wherein the processor models a plurality of sound objects into one sound object based on a distance between the sound objects to perform rendering according to the second rendering method.

5. The audio signal processing device of claim 1, wherein the first rendering method causes less distortion in timbre compared to the second rendering method.

6. The audio signal processing device of claim 5, wherein the first rendering method is a panning-based rendering method, and the second rendering method is a HRIR-based rendering method.

7. The audio signal processing device of claim 1, wherein the processor renders the object audio signal using the first rendering method and the second rendering method when the azimuth of the sound object with respect to the listener is within a third predetermined azimuth range, and generates the output audio signal by mixing an object audio signal rendered using the first rendering method and an object audio signal rendered using the second rendering method, wherein a difference between every azimuth corresponding to the first predetermined azimuth range and the azimuth in the front head direction of the listener is smaller than a difference between every azimuth corresponding to the third predetermined azimuth range and the azimuth in the front head direction of the listener, wherein the difference between the azimuth corresponding to the third predetermined azimuth range and the azimuth in the front head direction of the listener is smaller than the difference between the azimuth corresponding to the second predetermined azimuth range and the azimuth in the front head direction of the listener.

8. The audio signal processing device of claim 7, wherein the processor determines, based on the azimuth of the sound object with respect to the listener, mixing gains to be applied respectively to the object audio signal rendered using the first rendering method and the object audio signal rendered using the second rendering method.

9. The audio signal processing device of claim 8, wherein the processor uses interpolation according to a change in the azimuth of the sound object with respect to the listener to determine the mixing gains to be applied respectively to the object audio signal rendered using the first rendering method and the object audio signal rendered using the second rendering method.

10. A method for operating an audio signal processing device for rendering audio signals, the method comprising:

obtaining an input audio signal comprising an object audio signal;

rendering the object audio signal using a first rendering method when an azimuth of a sound object with respect to a listener is within a first predetermined azimuth range;

rendering the object audio signal using a second rendering method when the azimuth of the sound object with respect to the listener is within a second predetermined azimuth range, wherein a difference between every azimuth corresponding to the first predetermined azimuth range and an azimuth in a front head direction of the listener is smaller than a difference between every azimuth corresponding to the second predetermined azimuth range and the azimuth in the front head direction of the listener; and reproducing or transmitting an output audio signal comprising the object audio signal rendered using the first or second rendering method.

11. The method of claim 10, wherein the first rendering method requires a higher processing complexity compared to the second rendering method.

12. The method of claim 11, wherein the first rendering method is a head-related impulse response (HRIR)-based rendering method, and the second rendering method is a panning-based rendering method.

13. The method of claim 11, wherein, according to the second rendering method, a plurality of sound objects are modeled into one sound object based on a distance between the sound objects to perform rendering.

14. The method of claim 10, wherein the first rendering method causes less distortion in timbre compared to the second rendering method.

15. The method of claim 14, wherein the first rendering method is a panning-based rendering method, and the second rendering method is a HRIR-based rendering method.

16. The method of claim 10, further comprises:

rendering the object audio signal using the first rendering method and the second rendering method when the azimuth of the sound object with respect to the listener is within a third predetermined azimuth range, and generating the output audio signal by mixing an object audio signal rendered using the first rendering method and an object audio signal rendered using the second rendering method, wherein a difference between every azimuth corresponding to the first predetermined azimuth range and the azimuth in the front head direction of the listener is smaller than a difference between every azimuth corresponding to the third predetermined azimuth range and the azimuth in the front head direction of the listener, wherein the difference between every azimuth corresponding to the third predetermined azimuth range and the azimuth in the front head direction of the listener is smaller than the difference between every azimuth corresponding to the second predetermined azimuth range and the azimuth in the front head direction of the listener.

17. The method of claim 16, wherein the generating the output audio signal by mixing the object audio signal rendered using the first rendering method and the object audio signal rendered using the second rendering method comprises:

determining, based on the azimuth of the sound object with respect to the listener, mixing gains to be applied respectively to the object audio signal rendered using the first rendering method and the object audio signal rendered using the second rendering method.

18. The method of claim 17, wherein the determining the mixing gains comprises using interpolation according to a change in the azimuth of the sound object with respect to the listener to determine the mixing gains to be applied respectively to the object audio signal rendered using the first rendering method and the object audio signal rendered using the second rendering method.

* * * * *